United States Patent [19]

Aves, Jr. et al.

[11] Patent Number: 4,495,006

[45] Date of Patent: Jan. 22, 1985

[54] BOROCARBURIZING FERROUS SUBSTRATES

[75] Inventors: William L. Aves, Jr.; Gary A. Aves, both of Arlington, Tex.

[73] Assignee: Dresser Industries, Inc., Dallas, Tex.

[21] Appl. No.: 547,302

[22] Filed: Oct. 31, 1983

[51] Int. Cl.[3] ..... C21D 9/22; C23C 9/00

[52] U.S. Cl. ..... 148/16.5; 148/31; 148/15.5; 148/6

[58] Field of Search ..... 148/16.5, 31, 6, 19, 148/15.5

[56] References Cited

U.S. PATENT DOCUMENTS

| | | | |
|---|---|---|---|
| 3,842,921 | 10/1974 | Dill et al. | 175/374 |
| 3,922,038 | 11/1975 | Scales | 308/8.2 |
| 3,923,348 | 12/1975 | Peck | 308/8.2 |
| 4,012,238 | 3/1977 | Scales | 148/6 |
| 4,102,838 | 7/1978 | Scales | 148/16.5 |
| 4,188,242 | 2/1980 | Scales | 148/16.5 |
| 4,237,184 | 12/1980 | Gonseth et al. | 148/16.5 |

*Primary Examiner*—Veronica O'Keefe

*Attorney, Agent, or Firm*—Fred A. Winans

[57] ABSTRACT

A process is disclosed for case hardening of ferrous metal. In the process of the invention, the surface of the ferrous metal is exposed to diffusible carbon and boron in a furnace during multiple stages of a single thermal cycle without intermediate cooling. The furnace is maintained at a first temperature which enhances diffusion of the carbon to create a carburized substrate to a desired depth. The furnace temperature is then elevated to a second temperature to enhance diffusion of the boron to form an outer surface layer enriched therewith. This results in a gradual transition between the carburized substrate and the boronized layer.

19 Claims, 2 Drawing Figures

TIME AT TEMPERATURE PROFILE (REPRESENTATIVE) FOR BORO-CARBURIZING

TIME AT TEMPERATURE PROFILE (REPRESENTATIVE) FOR BORO-CARBURIZING

BOROCARBURIZING FERROUS SUBSTRATES

TECHNICAL FIELD

This invention relates to the treatment of ferrous materials, and in particular to the formation of a hard, wear resistant surface.

BACKGROUND ART

Ferrous metals are often used in environments where the surface is exposed to abrasive and corrosive elements. For example, in drilling oil wells, the wear surface of downhole earth boring equipment such as rotary bits, drilling tools and the components thereof are exposed to the highly abrasive activity of drilling in an environment laden with corrosive elements, often at elevated temperatures.

The desire to create a hard and durable outer surface to resist the abrasion and corrosion, while maintaining a ductile interior, has led to the science of case hardening of metals. In case hardening, a process is used which will produce a hard outer surface or case on the metal while permitting the core of the metal within to remain relatively soft and ductile when subjected to normal ferrous metal thermal treatment.

One common process of case hardening is carburizing. Carburizing is particularly effective with low carbon and alloy steels and permits selective surface hardening of the metals. Carburizing consists of the process of diffusing nascent carbon into a ferrous surface at an elevated temperature. The depth of penetration of the nascent carbon depends upon the temperature and length of time the ferrous material is exposed to a source of the carbon. The carbon can be supplied to the metal by a number of techniques. The ferrous surface can be exposed to a carbon rich gas or liquid. The material can also be surrounded by solid carburizing compounds to perform a pack carburization.

In addition to carburization, ferrous metals have been treated with other materials to provide other properties as required. For example, the diffusion of boron into a ferrous metal provides an outer case having greater resistance to corrosion and wear than that supplied by carburization. A boron case will also provide a lower case surface coefficient of friction than that provided by a carburized case.

A combination of these desirable properties has been achieved by both carburizing and boronizing a ferrous metal. In the past, a two stage process has been used to diffuse the carbon and boron into a ferrous metal. The metal is initially heated and exposed to nascent carbon to permit the carbon to diffuse into the surface of the metal to form a carbide substrate. The metal is subsequently cooled and reheated in the presence of boron. The boron diffuses into the metal surface to form a boron rich layer superimposed over the carbon rich layer.

U.S. Pat. No. 3,923,348 issued to Peck on Dec. 2, 1975 discloses a technique for hardening a bushing. The bushing has a ferrite and martensite core. A carbon diffused layer is provided on the ferrous substrate followed by a boron case. U.S. Pat. No. 3,922,038 to Scales issued on Nov. 25, 1975 discloses a treatment for ferrous substrate. In this technique, the ferrous surface is initially carburized. The ferrous material, after carburizing, is then boronized. Finally, the material is hardened and tempered. U.S. Pat. No. 4,188,242 to Scales issued on Feb. 12, 1980 discloses a method of carburizing and boronizing steel with subsequent hardening and tempering.

Several shortcomings have been noted in the processes disclosed in these patents and other known processes. Since the carbon diffused into the metal in the initial carburizing stage inhibits boron diffusion, only thin boride cases are possible, in the range of 0.003 inches to 0.006 inches. In addition, the diffusion of boron into the metal has a tendency to diffuse the carbon deeper into the metal to give rise to potentially undesirable additional carbon diffusion. In addition, the boron surface layer is found to be extremely brittle and subject to cracking. While this problem can be somewhat alleviated by placing the boron layer in compression, this limits the applications of the materials treated by these processes. To avoid cracking, the boron case thickness must be maintained within a specified range, again restricting the versatility of the materials treated by the process. Therefore, a need exists for an improved process which combines the advantages of the various materials and overcomes the shortcomings of the prior processes.

SUMMARY OF THE INVENTION

In accordance with one aspect of the present invention, a process for treating ferrous metals is provided. The process includes the step of exposing the metal to diffusible carbon and boron during separate stages of a single thermal cycle. The process further comprises the step of controlling the conditions at the metal surface to initially allow rapid diffusion of carbon into the metal to carburize the metal and subsequently allow rapid diffusion of the boron to boronize the metal, forming a gradual transition from the carburized to boronized layers.

In accordance with another aspect of the present invention, a ferrous member is provided. The ferrous member includes an outer surface having a carburized substrate and a boronized outer layer. A gradual transition between the carburized substrate and boronized outer layer is provided by exposing the ferrous metal to diffusible carbon and boron during a single thermal cycle without an intermediate cooling stage between the stages of carbon and boron diffusion and controlling the conditions of the ferrous member to initially allow rapid diffusion of carbon into the metal to carburize the member and subsequently allow rapid diffusion of boron into the metal to boronize the metal.

In accordance with yet another aspect of the present invention, a process for treating a ferrous metal is provided. The process includes the step of exposing the ferrous metal to diffusible carbon and boron during the same thermal cycle without cooling intermediate the diffusion of carbon and boron. The method further includes a step of varying the temperature of the ferrous metal surface to create a carbon rich substrate, an intermediate layer rich with $Fe_2B$ and $B_4C$ and an outer layer rich with FeB and $B_4C$ with a gradual transition between each layer to enhance the heat treatability of the ferrous metal.

BRIEF DESCRIPTION OF THE DRAWINGS

A more complete understanding of the invention can be had by reference to the following Detailed Description when taken in conjunction with the accompanying Drawings, wherein.

DETAILED DESCRIPTION

Figure 1:
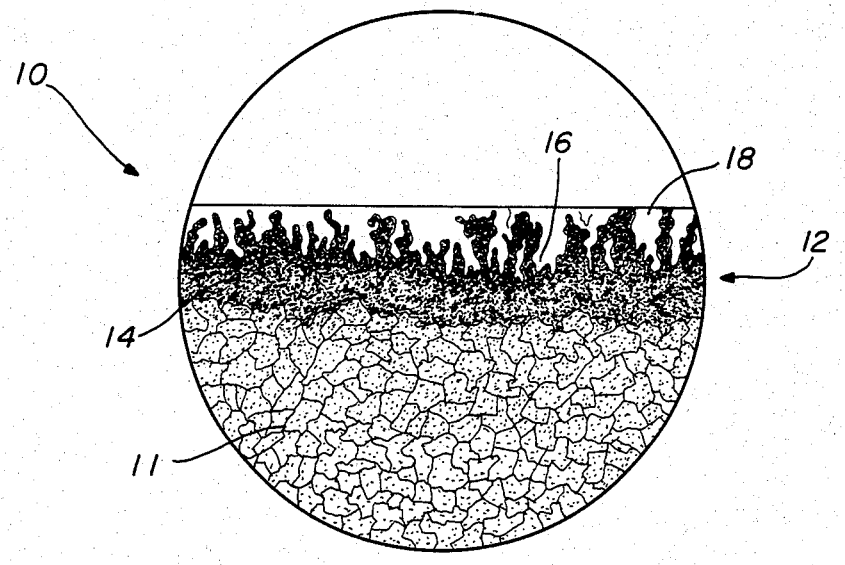
FIG. 1 is a representation of a photomicrograph of a ferrous metal after treatment by a process conducted with the teachings of the present invention.

With reference to FIG. 1, a representation of a photomicrograph of a ferrous metal member 10 is illustrated. The ferrous metal member 10 can be a part of a useful structure, and preferably comprises a low carbon or alloy steel base metal 11. The ferrous metal member has been treated in a manner described hereinafter to create a surface layer 12 as seen in FIG. 1 and which makes surface layer 12 particularly suitable for use as a wear surface. The surface layer 12 includes a carburized substrate 14, an intermediate boronized layer 16 rich with $Fe_2B$ and BC and an outer boronized layer 18 rich in FeB and BC. It will be understood that the transition between base metal 11, substrate 14, and layers 16 and 18 is continuous and gradual due to the process described hereinafter.

Reference is directed to the U.S. patent application Ser. No. 547,184, filed Oct. 31, 1983 and naming William L. Aves, Jr. as inventor and entitled, "Carburosiliconizing Ferrous Substrates" executed on Oct. 28, 1983. This patent application discloses a process for depositing carbon, boron and silicon in a ferrous metal in a continuous single thermal cycle. The procedures disclosed in the referenced application are suitable in the presence of silicon. However, upon removal of the silicon, the process disclosed in the referenced application is not as effective. The present application discloses and claims a process of depositing carbon and boron in a single thermal cycle without the use of silicon.

The surface layer 12 provides a coating or case for the ferrous metal member 10 which combines the attributes of carburizing and boronizing. The carburizing creates a hard surface and renders the member 10 heat treatable when required. The boronizing creates a layer at the surface of exceptional hardness for wear resistance. It has been found that the smooth and gradual transition between base metal 11, carbide substrate 14, and layers 16 and 18 provided by the process described hereinafter alleviates the tendency to brittleness and cracking of the surface layer found in prior processes, even in applications where the outer surface is not in compression.

In the present invention, the process of carburizing and boronizing a ferrous metal is completed during multiple stages of a single thermal cycle by exposing the metal to diffusible carbon and boron with no intermediate cooling between the carburizing and boronizing temperatures. By varying the conditions at the ferrous metal surface, the carburized substrate 14 will be formed initially. The intermediate and outer layers 16 and 18 are formed subsequently. In the preferred embodiment, the temperature at the ferrous metal surface is selected as the variable condition to selectively carburize and boronize the metal.

In one process performed under the teachings of the present invention, a 4815 steel, having a carbon content between 0.13% and 0.18%, was treated. A pack composition was employed to form the surface layer 12. This composition consisted of between 5% and 15% by weight amorphous boron, between 75% and 85% by weight of a carburizing compound consisting of a blend of between 10% and 20% by weight of barium carbonate, between 5% and 10% by weight calcium carbonate and the remainder a hardwood charcoal and/or coke, and about 10% by weight of an alkali earth fluoride (i.e. KF).

Figure 2:
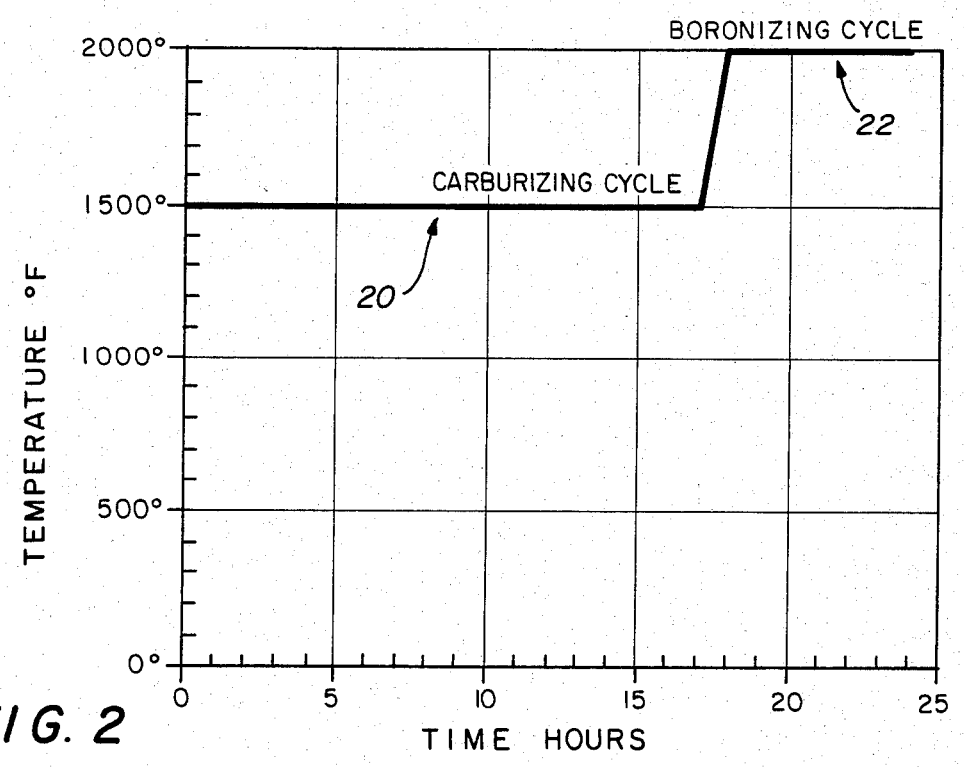
FIG. 2 is a graph of the temperature at the surface of a ferrous metal plotted against time during treatment by the process.

With reference to FIG. 2, the initial, carburizing phase 20 was performed at a temperature of approximately 1500° F. for a period of approximately seventeen hours. At this temperature, the carbide layer 14 is formed rapidly. The temperature is then increased over a period of approximately one hour to a final temperature of about 2000° F. At 2000° F., the boride phase 22 rapidly diffuses boron into the metal to form layers 16 and 18.

The rate of temperature change between the two temperature levels is generally not critical to the homogeneity of the transition zone between the carbon substrate 14 and layers 16 and 18. It will be understood that below 1650° F., only slow diffusion of borides will occur. However, at the higher temperatures boron diffusion will increase. It has been observed that once boronizing is initiated at temperatures above 1650° F., the boronizing layer inhibits the further deposition of a carburized layer. If boron were not present, carburizing would continue to take place at temperatures above 1650° F. Since the predominant deposition at the lower temperature is carbon and at the upper temperature boron, carbide substrate 14 and boride layers 16 and 18 will be formed.

Test results were taken from a metal treated under the teaching of the present invention. The surface layer 14 was found to have been approximately 0.006" thick. The coating hardness was measured with a 200 gm load on the Vicker's hardness test at KHN (Knoop Hardness Number) 1152, 1277 and 1299 in three measurements. The hardness of the metal at various depths are recorded below:

| Depth from Surface | Hardness (Rockwell "C") |
|---|---|
| .010 | 38–39 |
| .030 | 36 |
| .050 | 33 |
| .080 | 30 |
| .100 | 25 |
| .130 | 23 |
| .140 | 22 |

Under typical conditions, the boron rich layers 16 and 18 should have a hardness range of 1500 to 1800, perhaps even reaching 1900, on the Vicker's hardness scale. The carbon rich layer 14 should have a hardness range of 700 to 1000 on the Vicker's hardness scale. The base metal 11 would typically have a hardness range of 500 to 700 on the Vicker's hardness scale.

While this particular process was found to be effective on 4815 steel, the various compositions and process conditions can be varied to achieve the desired properties in the steel treated. Boron carbide and ferro boron powders can be substituted for the amorphous boron. In addition, potassium fluoroborate can be used as the alkali earth, replacing KF.

It is further anticipated that an effective pack composition will be made with the compounds in the following noted weight percentages:

| | |
|---|---|
| amorphous boron, boron carbide | 3%–20% by weight |

-continued

| | |
|---|---|
| or ferroboron carburizing compound | 75–85% by weight |

The carburizing compound can comprise the following compounds in weight percentages:

| | |
|---|---|
| barium carbide | 10–30% |
| calcium carbonate | 5–20% |
| remainder hardwood charcoal and/or coke | |
| alkali earth fluoride (either KF or potassium fluoroborate) | 2–10% by weight |

These percentages will vary to optimize the process for a particular time temperature profile and ferrous metal.

The operational temperature for, the carburizing of the ferrous metal is most effective in the temperature range between 1500° F. and 1700° F. The boronizing stage is initiated at about 1650° F. and continues to about 2100° F. Again, the optimum temperature for both stages will vary with the core material and relative richness of the pack composition. It is critical to maintain the temperature for carburizing a sufficiently long time to complete carburization since once the boronizing stage is entered, carburizing is effectively stopped. If the temperature is increased to 1650° F. too fast, iron boride will develop on the surface without a sufficient carburizing step to provide a smooth transition.

Although a pack composition was used in the previous example, the advantages of the present invention can be achieved by diffusion from a gas or fluid rich in carbon and boron. In gas diffusion, the ferrous metal article to be treated would be placed in the furnace. The temperature would then be raised to the proper temperature for carburizing in the presence of a gas, such as methane, and the temperature would be maintained until the desired carburizing depth is attained. The furnace would then be purged with an inert gas. After purging another gas would be introduced into the furnace from which boron could be liberated and diffused into the surface.

The rate of temperature climb from the predominantly carburizing temperature to the boronizing temperature is relatively noncritical. However, if the temperature increase rate is high, the transition from the substrate 14 to layers 16 and 18 will be more abrupt and distinct. If the temperature increase is slow, the transition will be more gradual and homogeneous.

Upon treatment under the teaching of the present invention, substrate 14 is carbide enriched, manifesting itself as a very fine precipitant of iron carbide. Layer 16 contains high concentrations of $Fe_2B$ and $B_4C$. Layer 18 contains high concentrations of FeB and $B_4C$. The process can also be controlled to essentially merge the layers 16 and 18 to have a relatively uniform layer enriched with iron borides and boron carbide. The surface treatment of the present invention is not believed to alter the grain size of the treated metal and the grain size is generally uniform throughout the ferrous material 11 and 12.

The process of the present invention has a number of advantages. The thickness of the subsurface layer 12 can be better controlled and made more uniform than possible in the prior art. The process of the present invention permits carburizing to a desired depth, followed immediately by boronizing. The process therefore eliminates the steps of cooling and reheating after carburizing which causes further diffusion of the carburized layer in prior art processes. In addition, with the particular pack composition suggested, the boride layer 18 can have a much greater depth. A 0.01 to 0.02 inch (10 to 20 mil) thick layer is possible under the teachings of the present invention while prior art processes cannot exceed 0.002 to 0.004 inches (2 to 4 mils) in boron layer thickness without risk of cracking at the surface.

The present invention also provides a process of great versatility with reduced energy requirements and better economies than possible with a two stage process. The gradual graduation between layers minimizes the thermal shock variations between the layers upon cooling from the high temperature cycle. The process provides low carbon and alloy steels with a high wear resistant case with a tough carbide support layer for supporting the boron layers 16 and 18. In addition, the carbide diffusion is controlled and excessive diffusion is prevented by the single thermal cycle process.

The process of the present invention provides commercial advantages since it requires only a single cycle heating process. It is undesirable to do any face finishing subsequent to case hardening or similar treatment since the finishing would remove portions of the treated surface. It is therefore critical that the surface treatment does not cause dimensional changes which would require subsequent finishing. By eliminating repetitive thermal cycles, the process of the present invention makes it easier to control or eliminate dimensional changes. A multicycle process requires multiple heatings and cool downs of the materials in process furnaces, resulting in large dimensional changes and expensive finishing costs. In addition, the cycle from high to low temperatures can result in undesirable molecular changes. The present process is also versatile and readily adaptable to ferrous metal configurations of a complex nature.

Although a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A process for treating ferrous metals comprising the steps of:

exposing the ferrous metal to diffusible carbon and boron during a single thermal cycle; and controlling the conditions at the ferrous metal surface to initially carburize the ferrous metal surface and subsequently boronize the ferrous metal surface, forming a gradual transition between the carburized and boronized layers.

2. The ferrous metal of claim 1 having a surface formed by the process of claim 1.

3. A process for treating a ferrous metal, comprising the steps of:

exposing the ferrous metal to diffusible carbon and boron within a single thermal cycle without an intermediate cooling stage; and varying the temperature at the ferrous metal surface to initially enhance diffusion of carbon into the surface to create a carburized substrate and subsequently enhance diffusion of boron to form a surface layer with a gradual transition between the substrate and surface layer to enhance the heat treatability of the ferrous metal.

4. The process of claim 3 wherein the variation of temperature to enhance boron diffusion operates to create an intermediate surface layer rich with $Fe_2B$ and $B_4C$ and an upper surface layer rich with FeB and $B_4C$.

5. The process of claim 3 wherein the variation of temperature to enhance boron diffusion operates to create a surface layer rich with iron borides and boron carbide.

6. The ferrous metal having a surface layer formed by the process of claim 3.

7. The process for treating ferrous metal, comprising the steps of:

exposing the surface of the ferrous metal to a diffusible carbon and boron conttained in a composition comprising between 3% and 20% by weight boron material, between 70% and 90% by weight of a carburizing compound and between 2% and 10% by weight of an alkali earth fluoride, said carburizing compound comprising between 10% and 20% by weight barium carbonate, between 5% and 10% by weight calcium carbonate with the remainder selected from the group comprising hardwood charcoal and coke; and varying the temperature at the ferrous metal surface to initially enhance diffusion of carbon to create a carburized substrate and subsequently enhance diffusion of boron without intermediate cooling to form a surface layer with a gradual transition between the substrate and surface layer.

8. The process of claim 7 wherein step of varying the temperature includes the step of maintaining the ferrous metal surface at a temperature in the range of 1500° F. to 1700° F. for enhanced carbon diffusion and elevating the temperature to within the range 1900° F. to 2100° F. to enhance boron diffusion.

9. The method of claim 7 wherein the alkali earth fluoride is potassium fluoride.

10. The process of claim 7 wherein the alkali earth fluoride is potassium fluoroborate.

11. The process of claim 7 wherein said boron material comprises amorphous boron.

12. The process of claim 7 wherein said boron material comprises boron carbide powder.

13. The process of claim 7 wherein said boron material comprises ferroboron powder.

14. The process of claim 8 wherein the rate of temperature elevation is set to provide a gradation between the carbide substrate and surface layer to resist surface cracking.

15. The ferrous metal having a surface treated by the process of claim 7.

16. A ferrous metal, comprising:

a surface layer having a carburized substrate and a boronized outer surface layer with a gradual transition therebetween formed by exposing the ferrous metal to diffusible carbon and boron and controlling the thermal conditions at the ferrous metal surface to initially enhance carbon diffusion to form the carburized substrate and subsequently enhance boron diffusion to form the outer surface layer during a single thermal cycle without intermediate cooling between the diffusion of carbon and boron.

17. A ferrous metal comprising:

an outer surface having a carburized substrate and a boronized outer surface layer with a gradual transition therebetween formed by exposing the ferrous metal to diffusible carbon and boron in a furnace at a first temperature for enhancing diffusion of the carbon to form a carburized substrate and subsequently elevating the furnace temperature to a second temperature for enhancing diffusion of boron to form the outer surface layer, the diffusion of carbon and boron being performed during a single thermal cycle without intermediate cooling between the first and second temperatures, the elevation of temperature from the first temperature to the second temperature providing a gradual transition between the carburized substrate and outer surface layer for improved heat treatability characteristics.

18. A process for treating a ferrous metal, comprising the steps of:

exposing the ferrous metal to a gas containing diffusible carbon at a first temperature to diffuse carbon into the surface of the ferrous metal to form a carburized surface layer;

purging the carbon bearing gas from about the ferrous metal with an inert gas;

exposing the ferrous metal to a gas containing diffusible boron at a second temperature without cooling of the ferrous metal from the first temperature to form a boron rich surface layer with a gradual transition between the base metal, carburized substrate and boron rich surface.

19. The process of claim 18 wherein said carbon bearing gas is methane.

* * * * *